US009157175B2

(12) United States Patent
Sawada et al.

(10) Patent No.: US 9,157,175 B2
(45) Date of Patent: Oct. 13, 2015

(54) FLY SEWING MACHINE

(75) Inventors: Toshiaki Sawada, Toyama (JP); Yoshifumi Nakata, Toyama (JP)

(73) Assignee: YKK Corporation (JP)

( * ) Notice: Subject to any disclaimer, the term of this patent is extended or adjusted under 35 U.S.C. 154(b) by 335 days.

(21) Appl. No.: 13/704,278

(22) PCT Filed: Jun. 16, 2010

(86) PCT No.: PCT/JP2010/060240

§ 371 (c)(1), (2), (4) Date: Dec. 14, 2012

(87) PCT Pub. No.: WO2011/158354

PCT Pub. Date: Dec. 22, 2011

(65) Prior Publication Data

US 2013/0092067 A1 Apr. 18, 2013

(51) Int. Cl.

*D05B 23/00* (2006.01)
*D05B 27/10* (2006.01)
*D05B 35/06* (2006.01)

(52) U.S. Cl.

CPC ..... *D05B 27/10* (2013.01); *D05B 35/064* (2013.01); *D10B 2501/06* (2013.01)

(58) Field of Classification Search

CPC ..... D05B 35/06; D05B 35/064; D05B 27/10; D05B 27/12; D05B 27/14

See application file for complete search history.

(56) References Cited

U.S. PATENT DOCUMENTS 3,754,519 A 8/1973 Howell
4,290,376 A * 9/1981 Brusasca et al. ..... 112/470.32
4,362,116 A * 12/1982 Sen Gupta et al. ..... 112/470.03
4,572,094 A * 2/1986 Taddicken ..... 112/322
4,576,104 A 3/1986 Miyakawa
4,611,546 A 9/1986 Miyakawa
4,644,886 A 2/1987 Miyakawa
4,979,450 A * 12/1990 Dudek et al. ..... 112/113
5,209,171 A * 5/1993 Anderson ..... 112/7
5,331,910 A 7/1994 Mukai et al.

(Continued)

FOREIGN PATENT DOCUMENTS

AR 241854 A 1/1993
AR 242094 A 3/1993

(Continued)

OTHER PUBLICATIONS

International Search Report, PCT Application No. PCT/JP2010/060240, mailed Aug. 10, 2010.

(Continued)

*Primary Examiner* — Nathan Durham
(74) *Attorney, Agent, or Firm* — Kilpatrick Townsend & Stockton LLP

(57) ABSTRACT

There is provided a fly sewing machine. A fly supply unit is configured to supply flies to a transfer passage. A fly transfer unit is configured to transfer and send the fly supplied by the fly supply unit toward the downstream side thereof. A chain feed unit is configured to feed a slide fastener chain onto the flies sent by the fly transfer unit. An auxiliary conveyance unit is configured to press the flies and the slide fastener chain which are overlapped by the chain feed unit from above or below, and to send the flies and the slide fastener chain toward the downstream side thereof. A sewing machine part is configured to stitch together the flies and the slide fastener chain sent by the auxiliary conveyance unit.

5 Claims, 12 Drawing Sheets

(56) References Cited

U.S. PATENT DOCUMENTS

| | | | | |
|---|---|---|---|---|
| 5,605,106 | A * | 2/1997 | Ackermann et al. | 112/475.01 |
| 5,701,833 | A | 12/1997 | Suzuki | |
| 6,055,918 | A * | 5/2000 | Hajjar et al. | 112/7 |
| 7,080,605 | B1 * | 7/2006 | Anderson | 112/318 |
| 7,124,696 | B2 * | 10/2006 | Lobur | 112/7 |
| 7,430,974 | B2 * | 10/2008 | Sho et al. | 112/470.33 |
| 2006/0144309 | A1 | 7/2006 | Sho et al. | |

FOREIGN PATENT DOCUMENTS

| | | | |
|---|---|---|---|
| AU | 555311 | B | 8/1985 |
| AU | 4613785 | A | 2/1986 |
| AU | 4706685 | A | 3/1986 |
| AU | 559782 | B | 3/1987 |
| AU | 8348191 | A | 3/1992 |
| BR | 8504126 | A | 6/1986 |
| BR | 8504552 | A | 7/1986 |
| CA | 1237026 | A | 5/1986 |
| CA | 1237025 | A | 5/1988 |
| CA | 2179129 | A1 | 12/1996 |
| CA | 2179129 | A | 8/2015 |
| CN | 1786314 | A | 6/2006 |
| DE | 3574225 | D | 12/1989 |
| DE | 3574666 | D | 1/1990 |
| DE | 69115388 | C | 7/1996 |
| EP | 173247 | A2 | 3/1986 |
| EP | 174598 | A2 | 3/1986 |
| EP | 751250 | A3 | 7/1997 |
| ES | 547198 | A | 8/1985 |
| ES | 547199 | A | 8/1985 |
| ES | 546931 | A | 9/1985 |
| ES | 546932 | A | 9/1985 |
| FI | 852800 | A | 2/1986 |
| FI | 853332 | A | 3/1986 |
| GB | 2163482 | A | 2/1986 |
| GB | 2164387 | A | 3/1986 |
| HK | 92889 | A | 12/1989 |
| HK | 60990 | A | 8/1990 |
| ID | 987 | B | 10/1996 |
| JP | 62-46197 | B2 | 10/1987 |
| JP | 63-9878 | B2 | 3/1988 |
| JP | 64-7797 | B2 | 2/1989 |
| JP | 6-7568 | A | 1/1994 |
| JP | 9-10459 | A | 1/1997 |
| JP | 2668746 | B2 | 10/1997 |
| JP | H10-118371 | A | 5/1998 |
| JP | 2006-158705 | A | 6/2006 |
| KR | 10-1987-0000490 | B1 | 1/1987 |
| KR | 10-1987-0000616 | B1 | 9/1988 |
| PL | 378284 | A | 6/2006 |
| SG | 55589 | G | 12/1989 |
| SG | 57590 | G | 9/1990 |
| TR | 200504815 | A | 8/2006 |

OTHER PUBLICATIONS

Office Action, Chinese Patent Application No. 201080068276.3, mailed Aug. 19, 2013.

* cited by examiner

FLY SEWING MACHINE

This application is a national stage application of PCT/JP2010/060240 which is incorporated herein by reference.

TECHNICAL FIELD

The present invention relates to a fly sewing machine which continuously stitches a plurality of flies each made of a piece of cloth such as a fly front of trousers onto an elongated slide fastener chain.

BACKGROUND ART

As is known in the related art, a fly sewing machine includes a fly supply unit which supplies flies from the upstream side along a fly transfer passage which is provided on a stand, a fly feed unit which sequentially transfers the flies supplied by the fly supply unit, a transfer speed-adjusting part which sends the flies transferred by the fly transfer unit to a sewing machine part in the downstream side at required timing, and a chain feed unit provided between the transfer speed-adjusting part, the chain feed unit sending a continuous slide fastener chain to the sewing machine part in synchronization with the sewing speed of the sewing machine part (e.g., refer to Patent Document 1).

PRIOR ART DOCUMENT

Patent Document

Patent Document 1: Japanese Patent Application Publication No. 2006-158705A

SUMMARY OF INVENTION

Problems to be Solved by Invention

However, in the fly sewing machine described in foregoing Patent Document 1, when the length of a fly is shorter than the distance between the position at which the transfer speed-adjusting part sends flies and the position of a pressing member of the sewing machine part (in the case of the flies used in trousers for children), the flies are sent downstream in that section, owing to extrusion force of a next fly which is sent by the transfer speed-adjusting part and frictional force with the slide fastener chain fed by the chain feed unit. Consequently, the sending of the flies tends to be instable, so that the flies are not normally stitched to the slide fastener chain.

The present invention has been made keeping in mind the above problems occurring in the related art, and an object of the present invention is to provide a fly sewing machine which ensures that flies are stably fed and makes it possible to properly attach the flies to a slide fastener chain, even if the flies are short.

Means for Solving Problems

The object of the present invention is achieved by the following configurations.

(1) A fly sewing machine configured to continuously stitch a plurality of flies each made of a piece of cloth to an elongated slide fastener chain, the fly sewing machine that includes a fly supply unit configured to supply the flies to a fly transfer passage; a fly transfer unit disposed downstream of the fly supply unit and configured to transfer and send the flies supplied by the fly supply unit to a downstream side thereof; a chain feed unit disposed downstream of the fly transfer unit and configured to feed the slide fastener chain onto the flies sent by the fly transfer unit; an auxiliary conveyance unit disposed downstream of the chain feed unit and configured to press the flies and the slide fastener chain which are overlapped by the chain feed unit from above or below and to send the flies and the slide fastener chain to a downstream side thereof; and a sewing machine part disposed downstream of the auxiliary conveyance unit and configured to stitch the flies to the slide fastener chain.

(2) The fly sewing machine according to (1), in which the auxiliary conveyance unit includes at least one needle section configured to penetrate through at least one of the flies and the slide fastener chain.

(3) The fly sewing machine according to (2), in which the auxiliary conveyance unit includes a support shaft provided perpendicular to the fly transfer passage and at least one roller rotatably supported by the support shaft, and the at least one needle section is a plurality of the needle sections which are provided on an outer circumferential surface of the at least one roller.

(4) The fly sewing machine according to (3), in which the at least one roller is a pair of rollers rotatably provided on both ends of the support shaft and the auxiliary conveyance unit further includes the pair of the rollers and a rotary shaft provided along the fly transfer passage, the rotary shaft pivotably supporting the support shaft.

(5) The fly sewing machine according to any one of (1) to (4), in which a power of the auxiliary conveyance unit is a sending force of the sewing machine part for sending the flies and the slide fastener chain which are overlapped to the downstream side thereof while stitching the flies and the slide fastener chain together.

Advantageous Effects of Invention

According to the fly sewing machine of the invention, the fly sewing machine includes a fly supply unit configured to supply the flies to a fly transfer passage; a fly transfer unit disposed downstream of the fly supply unit and configured to transfer and send the flies supplied by the fly supply unit to a downstream side thereof; a chain feed unit disposed downstream of the fly transfer unit and configured to feed the slide fastener chain onto the flies sent by the fly transfer unit; an auxiliary conveyance unit disposed downstream of the chain feed unit and configured to press the flies and the slide fastener chain which are overlapped by the chain feed unit from above or below and to send the flies and the slide fastener chain to a downstream side thereof; and a sewing machine part disposed downstream of the auxiliary conveyance unit and configured to stitch the flies to the slide fastener chain. Even if the length of each fly is shorter than the distance between the position at which the transfer speed-adjusting part sends the flies and the position of a pressing member of the sewing machine part, it is possible to stably send the flies and thus normally stitch the flies to the slide fastener.

EMBODIMENTS OF INVENTION

Hereinafter, an embodiment of a fly sewing machine according to the present invention will be described in detail with reference to the accompanying drawings.

Figure 1:
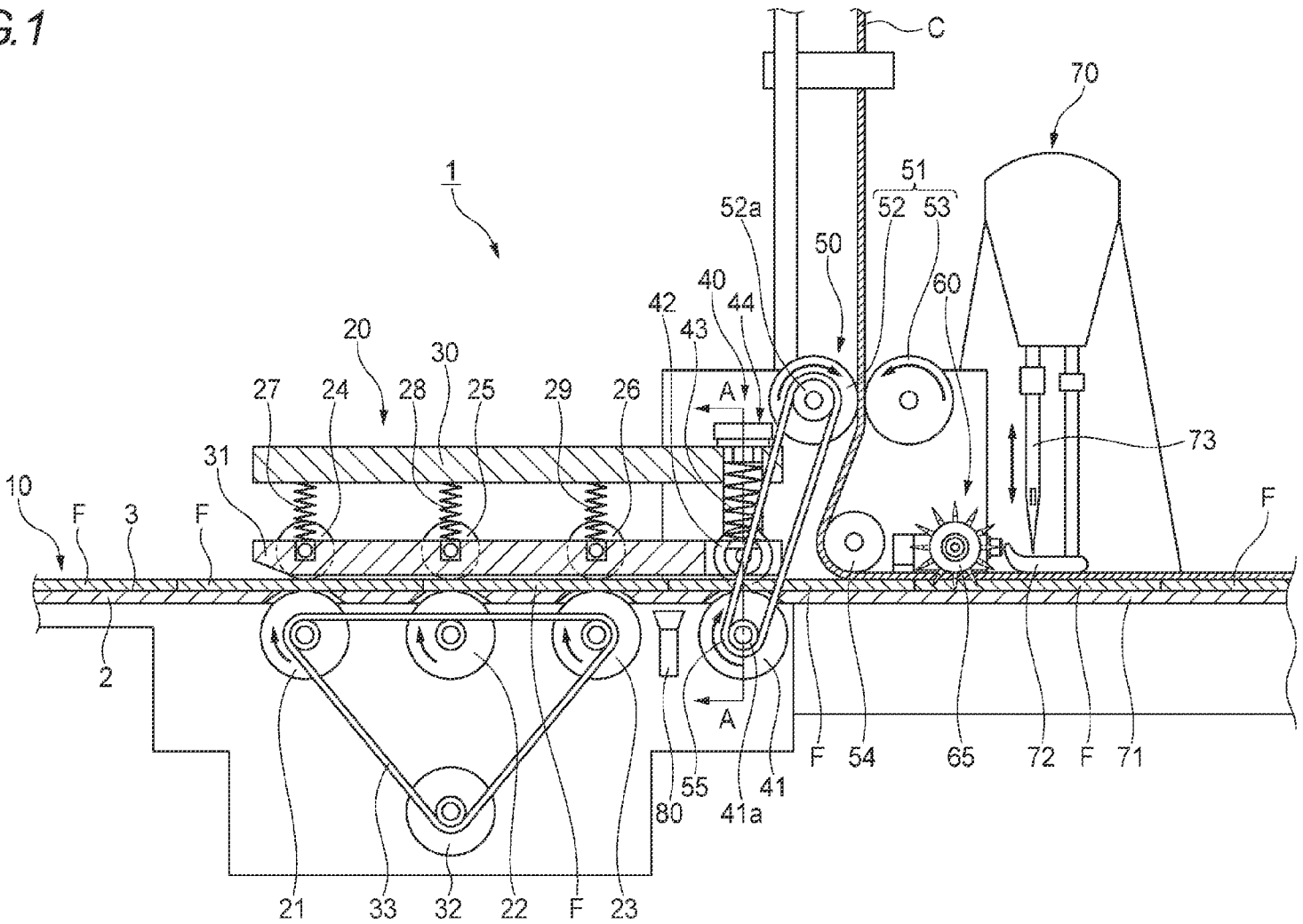
FIG. 1 is a partially-cutaway side view depicting one embodiment of a fly sewing machine according to the invention.

As shown in FIG. 1, the fly sewing machine of this embodiment includes a stand 2 having a fly transfer passage 3 provided on a top surface thereof such that flies F are transferred along the fly transfer passage 3; a fly supply unit 10 which supplies the flies F to the fly transfer passage 3 of the stand 2; a fly transfer unit 20 disposed downstream of the fly supply unit 10, the fly transfer unit 20 which transfers and sends the flies F supplied by the fly supply unit 10 to the downstream side thereof; a chain feed unit 50 disposed downstream of the fly transfer unit 20, the chain feed unit 50 which feeds a slide fastener chain C onto the flies F sent by the fly transfer unit 20; an auxiliary conveyance unit 60 disposed downstream of the chain feed unit 50, the auxiliary conveyance unit 60 which presses the flies F and the slide fastener chain C which are overlapped in the chain feed unit 50 from above or below and sends the flies F and the slide fastener chain C to the downstream side thereof; and a sewing machine part 70 disposed downstream of the auxiliary conveyance unit 60, the sewing machine part 70 which stitches the flies F to the slide fastener chain C.

The fly supply unit 10 is formed of the upstream end of the fly transfer passage 3 which extends upstream from the fly transfer unit 20. In addition, in this embodiment, new flies F are adapted to be manually loaded in sequence onto the fly supply unit 10. In the meantime, it is also possible to drive a feed roller (not shown) in synchronization with the sewing speed and automatically load or introduce new flies F.

The fly transfer unit 20 includes first to third drive rollers 21 to 23 which are disposed at predetermined intervals along the fly transfer passage 3, first to third support rollers 24 to 26 which are disposed above the first to third drive rollers 21 to 23 such that a respective support roller faces a respective drive roller, first to third springs 27 to 29 which elastically urge the first to third support rollers 24 to 26 toward the first to third drive rollers 21 to 23, upper and lower support frames 30 and 31 which support the first to third support rollers 24 to 26 toward the first to third drive rollers 21 to 23 such that the support, rollers 24 to 26 can freely reciprocate, and a transfer speed-adjusting part 40 which sends the flies F transferred by the first to third drive rollers 21 to 23 to the downstream side at required timing.

The first to third drive rollers 21 to 23 are rotatably supported on the stand 2 in the state in which the transfer surfaces thereof are slightly exposed out of the fly transfer passage 3 from above, and are driven by a power transmission belt 33 which is driven by a single drive motor 32 so that the drive rollers 21 to 23 rotate at the same speed. In addition, the first to third springs 27 to 29 are compressive springs, and spring force thereof are set to a weak range, for example, from 0.05 kgf to 0.5 kgf.

The transfer speed-adjusting part 40 includes a fourth drive roller 41 which is rotatably supported on the stand 2, a fourth support roller 42 which is disposed above the fourth drive roller 41 and is rotatably supported on the upper and lower support frames 30 and 31, fourth springs 43 which elastically urge the fourth support roller 42 toward the fourth drive roller 41, and a roller interval-adjusting section 44 which adjusts the interval between the fourth drive roller 41 and the fourth support roller 42 by changing a descent limit position of the fourth roller 42. The driving of the fourth roller 41 is interlocked with the driving of the chain feed rollers 51 and 52 of the chain feed unit 50, i.e. the sewing operation of the sewing machine part 70.

In addition, the speed of rotation of the fourth drive roller 41 is set to be faster than the sewing speed in the sewing machine part 70. In the meantime, in this embodiment, the speed of rotation of the fourth drive roller 41 is set to be, for example, 10 to 15% faster than the sewing speed. In addition, the speed of rotation of the first to third drive rollers 21 to 23 is set to be faster than the speed of rotation of the fourth drive roller 41.

In addition, in this embodiment, the outer circumference of the first to third rollers 21 to 23 is knurled, and the outer circumference of the first to third support rollers 24 to 26 is formed as a flat surface. In addition, the outer circumference of the fourth drive roller 41 and the fourth support roller 42 is knurled.

In the meantime, in this embodiment, the diameter of the fourth support roller 42 is set to be smaller than the diameter of the fourth drive roller 41. For example, the diameter of the fourth drive roller 41 is set 30 mm, and the diameter of the fourth support roller 42 is set 20 mm. In addition, the diameter of the fourth support roller 42 is set ⅔ of the diameter of the fourth drive roller 41. In addition, the fourth springs 43 are compressive springs, and for example, the spring force thereof is set to the range from 2 kgf to 4 kgf, which is approximately 8 to 40 times the spring force of the first to third springs 27 to 29.

Figure 2:
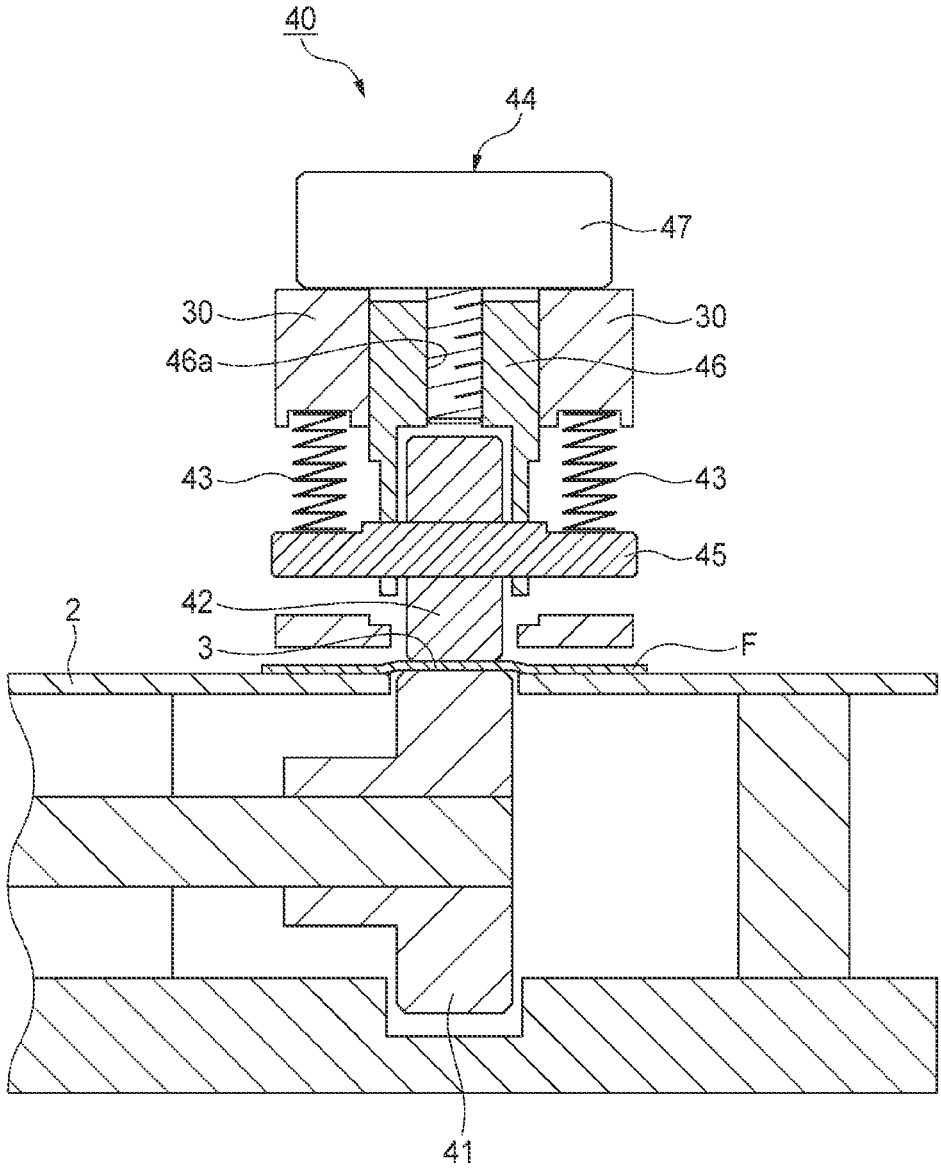
FIG. 2 is a cross-sectional view taken in the direction of arrows of line A-A of the transfer speed-adjusting part shown in FIG. 1.
Figure 3:
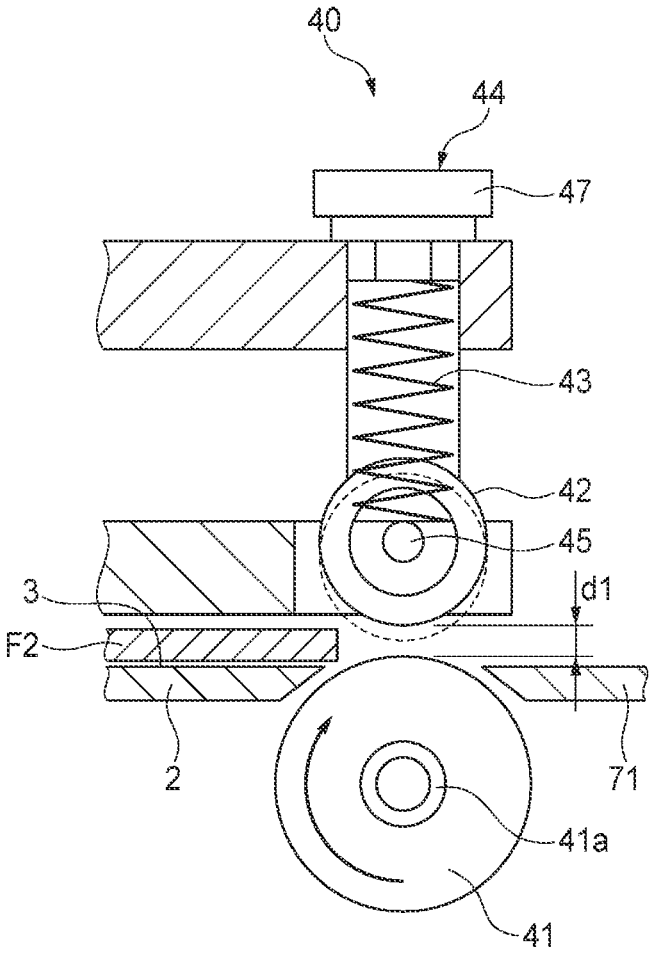
FIG. 3 is an enlarged side view depicting the operation of adjusting the interval between the fourth drive roller and the fourth support roller between the transfer speed-adjusting part.

As shown in FIG. 2, the roller interval-adjusting section 44 includes a support shaft 45 which rotatably supports the fourth support roller 42, a shaft support member 46 which supports left and right shaft ends of the support shaft 45 so as not to rotate and can slide up and down between the left and right upper support frames 30, and an adjustment screw 47 having a dial which is screwed into a screw-hole **46*a* which is formed in the central portion of the shaft support member 46 so as to penetrate in the vertical direction when seen from the plane of the shaft support member 46. The respective fourth springs 43 are mounted between the left and right shaft ends of the support shaft 45 which is fixedly disposed in the left, and right upper support frames 30 and the shaft support member 46. Turning the adjustment screw 47 having the dial in the screwing direction decreases the interval between the fourth drive roller 41 and the fourth support roller 42 (see the wavy line in FIG. 3). Turning the adjustment screw 47 having the dial in the direction opposite to the screwing direction increases the interval between the fourth drive roller 41 and the fourth support roller 42 (see the solid line in FIG. 3**).

The sewing machine part 70 has a support table 71 on the upper surface of which the fly transfer passage 3 along which the flies F are transferred is provided, a pressing section 72, a pair of sewing needles 73 which stitches the flies F to the slide fastener chain C, and a transfer member which is not shown.

The chain feed unit 50 has a chain feed roller part 51 which draws the slide fastener chain C from a chain reservoir disposed above the sewing machine part 70, sends the chain downwards, is driven by a pair of front and rear independent power transmission motors which are not shown, and is composed of a drive roller 52 and a follower roller 53. The chain feed unit 50 also includes a chain guide roller 54 disposed below the chain feed roller part 51. In addition, the slide fastener chain C which is sent downwards by the chain feed roller part 51 is redirected by the chain guide roller 54, and is fed onto flies F sent by the transfer speed-adjusting part 40.

In addition, in the fourth drive roller 41 of the transfer speed-adjusting part 40 and the drive roller 52 of the chain feed roller part 51, respective power transmission pulleys 41*a* and 52*a* are connected via a power transmission belt 55. Therefore, the fourth drive roller 41 is driven to rotate in synchronization with the drive roller 52.

In addition, in this embodiment, as shown in FIG. 1, a photoelectric detector 80 is provided below the fly transfer passage 3 between the third drive roller 23 and the fourth drive roller 41. The photoelectric detector 80 is configured such that the sewing machine part 70 and the fourth drive roller 41 start to operate when light is blocked by the flies F which pass through the detecting area of the photoelectric detector 80 but the sewing machine part 70 and the fourth drive roller 41 stop operating when an interval is formed between a preceding fly F and a following fly F. In the meantime, the first to third drive rollers 21 to 23 continue operating even when the transfer speed-adjusting part 40 is stopped. That is, when the photoelectric detector 80 detects the rear end of the preceding fly F has passed by the photoelectric detector 80 in the state in which the interval is formed between the preceding fly F and the following fly F, the operation of sewing and transferring the preceding fly F1 stops. While the operation of sewing and transferring the preceding fly F1 is stopped, the following fly F2 which is continuously transferred. When the leading end of the following fly F2 passes by and covers the photoelectric detector 80 from light, the operation of sewing and transferring the preceding fly F is resumed.

Here, since the speed of transferring the following fly F2 is faster than the speed of transferring the preceding fly F1, the following fly F2 catches up the preceding fly F1 while the preceding fly F1 passes through transfer speed-adjusting part 40. In this state, the leading end of the following fly F2 is in contact with the rear end of the preceding fly F1. In this contact state, the leading end of the following fly F2 tends to climb over the rear end of the preceding fly F1 because the speed of transferring the following fly F2 surpasses the speed of transferring the preceding fly F1. However, because the spring force of the first to third springs 27 to 29 which urge the first to third support rollers 24 to 26 of the fly transfer unit 20 is small and the outer circumference of the first to third support rollers 24 to 26 is flat, the following fly F2 slips between the first to third drive rollers 21 to 23 and the first to third support rollers 24 to 26 and thus does not climb over the preceding fly F1. In addition, even though the following fly F2 slightly climbed over the preceding fly F1, the following fly F2 collides against the outer circumference of the fourth support roller 42 of the transfer speed-adjusting part 40, thereby failing to move forward further. This consequently ensures that the preceding fly F1 passes first in the transfer speed-adjusting part 40.

Figure 4:
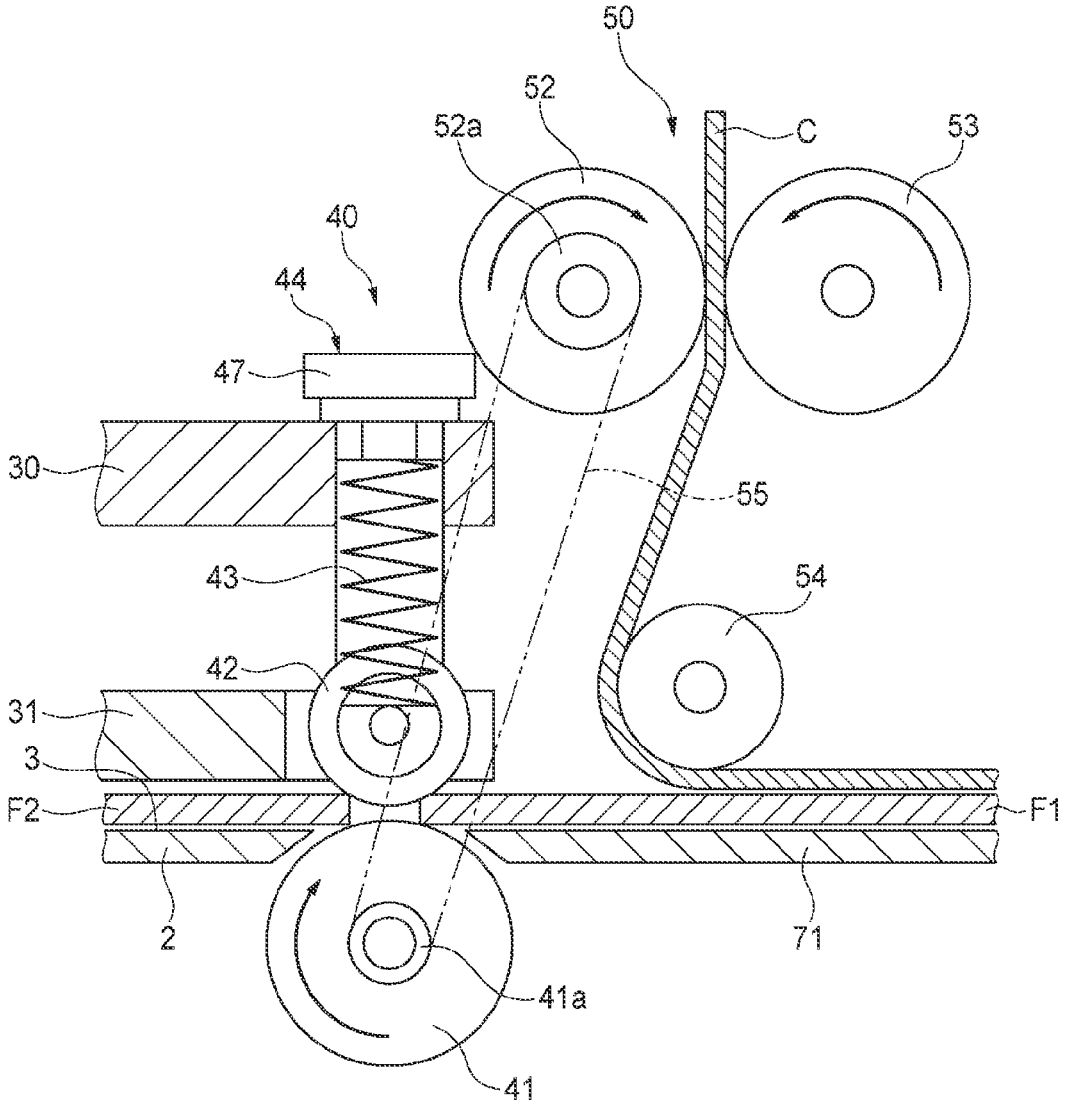
FIG. 4 is an enlarged side view depicting the state before the following fly enters the interval between the fourth drive roller and the fourth support roller.
Figure 5:
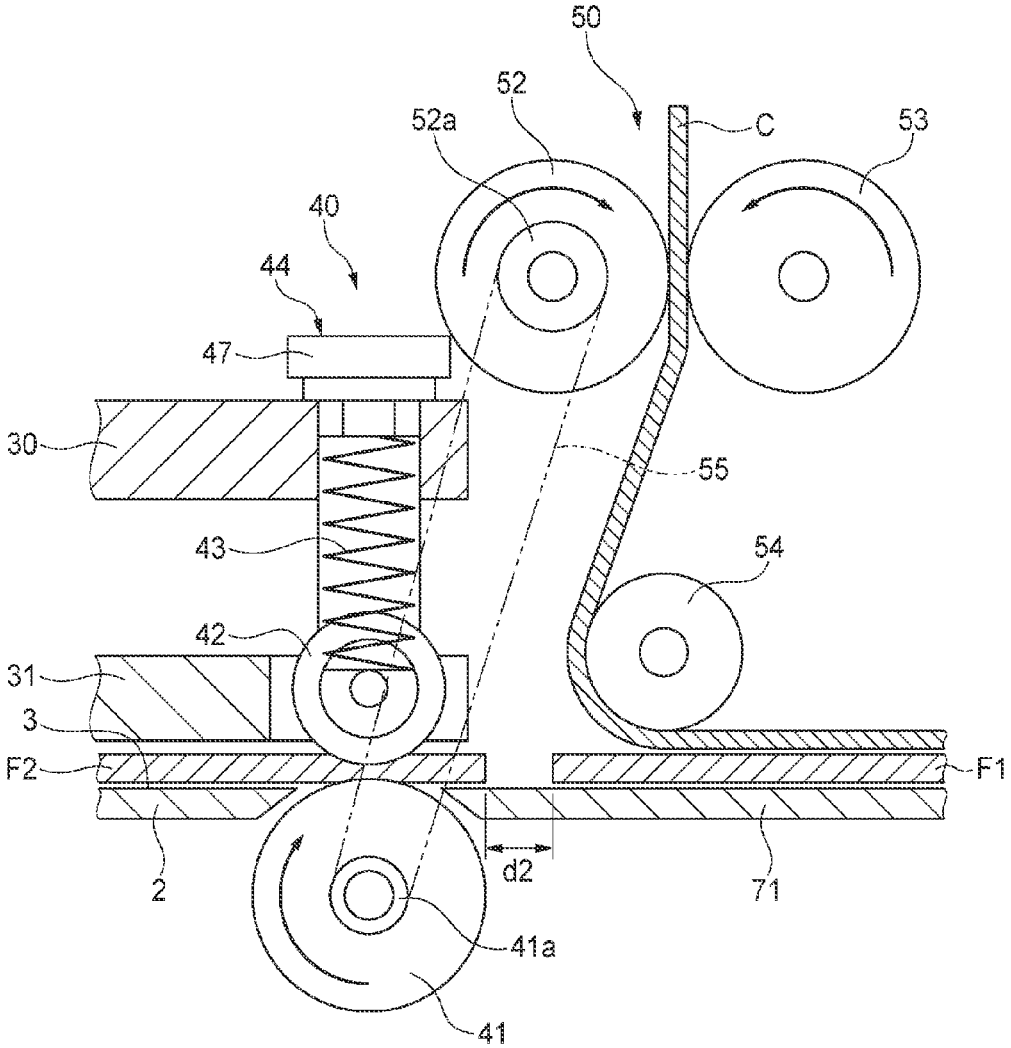
FIG. 5 is an enlarged side view depicting the state in which the interval is formed between the preceding fly and the following fly.

In this way, while the preceding fly F1 continues being stitched to the slide fastener chain C by the sewing machine part 70 in the state in which the leading end of the following fly F2 is in contact with the rear end of the preceding fly F1, the leading end of the following fly F2 comes with contact with the respective outer circumference of the fourth drive roller 41 and the fourth support roller 42 toward the interval, between the rollers 41 and 42 of the transfer speed-adjusting part 40, as shown in FIG. 4. Here, since the size of the interval d1 between the fourth drive roller 41 and the fourth support roller 42 is smaller than the cloth thickness of the following fly F2, the following fly F2 cannot instantaneously enter the interval between the respective rollers 41 and 42 but takes more or less time to enter this interval. In the meantime, the preceding fly F1 is actively transferred in the transfer speed-adjusting part 40 at a higher speed than the sewing speed by the sewing machine part 70. As a result, as shown in FIG. 5, an interval d2 is formed between the preceding fly F1 and the following fly F2. In addition, this interval d2 depends on the cloth thickness and ductility of the flies F and the size of the interval d1 between the fourth drive roller 41 and the fourth support roller 42, but is not uniformly determined.

In addition, the flies F which pass through the fourth drive roller 41 and the fourth support roller 42 of the transfer speed-adjusting part 40 are reliably transferred, since the outer circumference of the fourth drive roller 41 and the fourth support roller 42 is knurled, and the spring force of the fourth spring 43 is set to be greater than that of the first to third springs 27 to 29.

However, when the flies F simply enter the interval between the fourth drive roller 41 and the fourth support roller 42, the transfer speed-adjusting part. 40 is transferred in the state in which the following fly F2 is in contact with the preceding fly F1, the speed of transferring the transfer speed-adjusting part 40 is faster than the sewing speed, and holding force between the fourth drive roller 41 and the fourth support roller 42 in the transfer speed-adjusting part 40 is extremely great. Consequently, there is possibility that the flies F would be sent to the sewing machine part 70 in the state in which the leading end of the following fly F2 is placed on the rear end of the preceding fly F1. In the meantime, when, the interval between the fourth drive roller 41 and the fourth support roller 42 is too great, it takes too much time for the flies F to enter the interval between the fourth drive roller 41 and the fourth support roller 42, so that the interval d2 between the preceding fly F1 and the following fly F2 becomes excessively great. Consequently, it is impossible to produce an intended interval.

The interval d2 between the preceding fly F1 and the following fly F2 is not uniform owing to the preferences of sewing manufacturers. In an example, some manufacturers prefer the state in which the preceding fly F1 and the following fly F2 are in contact, whereas other manufacturers prefer the state in which a certain interval is set between the preceding fly F1 and the following fly F2. Therefore, there are strong desires at sewing sites for the ease of the operation of adjusting the interval. In the present invention, it is possible to simply adjust the interval, between the fourth, drive roller 41 and the fourth support roller 42 by simply rotating the adjustment screw 47 having a dial of the transfer speed-adjusting part 40 as described above.

Figure 6:
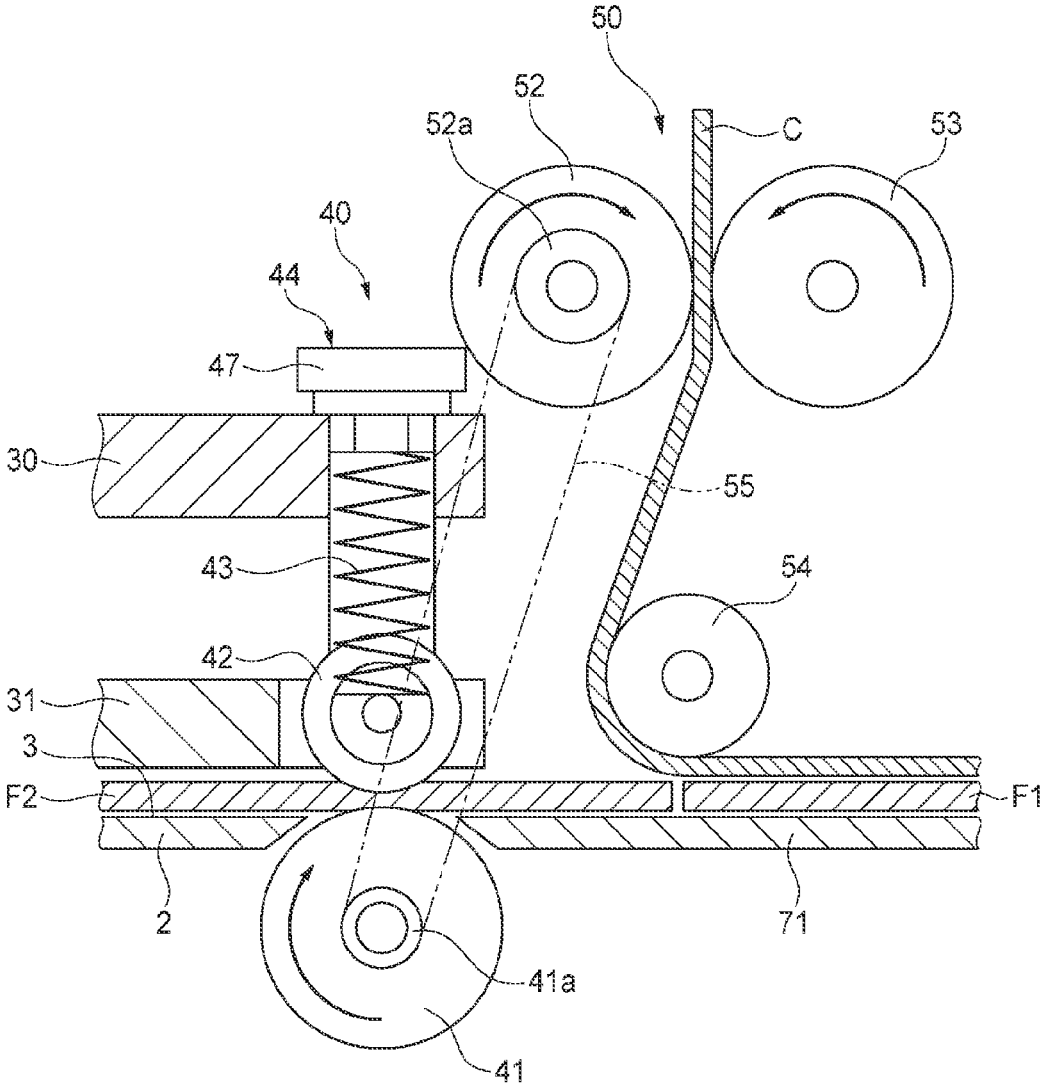
FIG. 6 is an enlarged side view depicting the state in which a following fly enters between the slide fastener chain and the support table.

In addition, when the following fly F2 enters the interval between the fourth drive roller 41 and the fourth support roller 42, the following fly F2 catches up the preceding fly F1 which is being sewn since the driving speed of the fourth drive roller 41 surpasses the driving speed of the sewing machine part 70. Consequently, as shown in FIG. 6, the following fly F2 is introduced between the slide fastener chain C, the transfer of which is guided by the chain guide roller 54, and the support table 71. Here, it is possible to adjust the final interval between the preceding fly F1 and the following fly F2 at any value by suitably selecting the speed ratio between the sewing speed of the sewing machine part 70 and the driving speed of the fourth drive roller 41.

Figure 7:
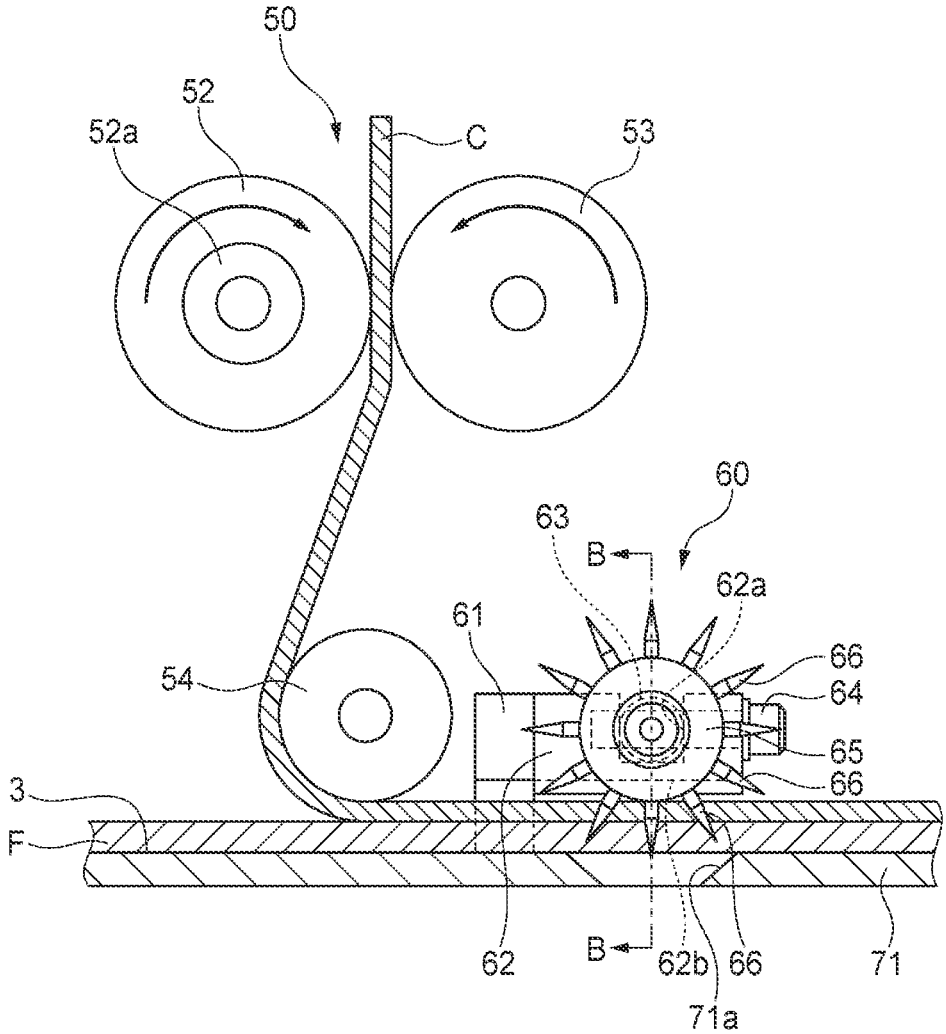
FIG. 7 is an enlarged side view of the surroundings of the auxiliary conveyance unit shown in FIG. 1.
Figure 8:
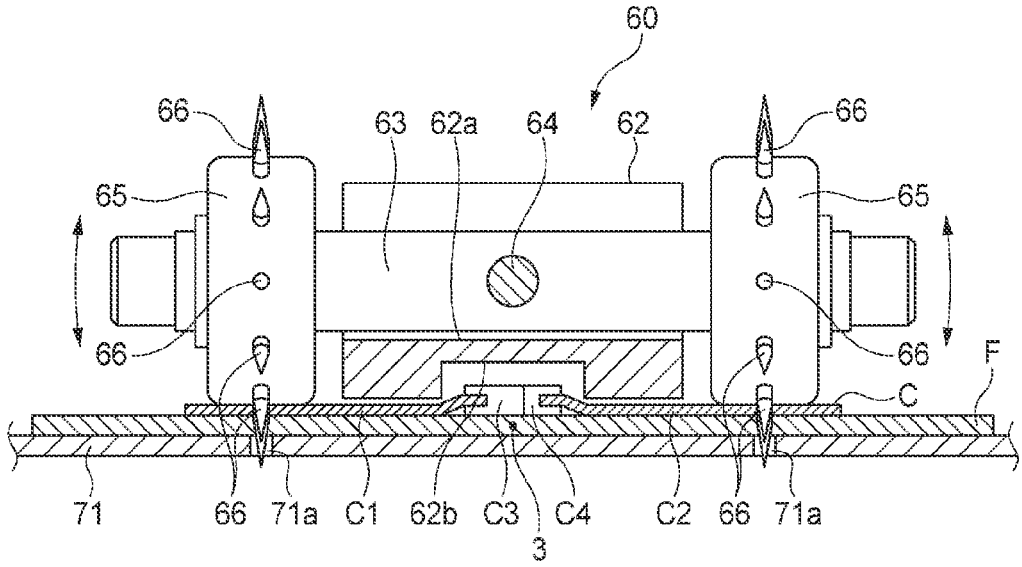
FIG. 8 is a cross-sectional view taken in the direction of line B-B of the auxiliary conveyance unit shown in FIG. 7.

As shown in FIG. 7 and FIG. 8, the auxiliary conveyance unit 60 includes a support section 61, a base member 62, a support shaft 63, a rotary shaft 64 and a pair of rollers 65. The support section 61 is disposed on the support table 71. The base member 62 is attached to the support section 61, and is disposed above the flies F and the slide fastener chain C, which are overlapped each other in the chain feed unit 50, with a predetermined interval. The support shaft 63 is fitted into a recess 62*a* which is formed in the width direction of the base member 62. The rotary shaft 64 extends through a longitudinal central section of the support shaft 63, which is disposed in the recess 62*a*, along the fly transfer passage 3, and pivotably supports the support shaft 63. The pair of rollers 65 is rotatably supported on opposite ends of the support shafts 63. Consequently, the support shaft 63 is provided perpendicular to the fly transfer passage 3, and the rotary shaft 64 is provided along the fly transfer passage 3. In addition, the support shaft 63 is supported such, that the support shaft 63 can pivot about the rotary shaft 64. In the meantime, the slide fastener chain C includes a pair of left and right fastener tapes C1 and C2 and a plurality of fastener elements C3 and C4 which are attached to the fastener tapes C1 and C2 along opposing tape side edges of the fastener tapes C1 and C2.

The pair of rollers 65 is disposed such that a respective roller 65 presses, from above, a respective one of the pair of left and right fastener tapes C1 and C2 of the slide fastener chain C that are overlapped on the flies F in the chain feed unit 50. A plurality of needle sections 66 (12 needle sections in this embodiment) which penetrates through the flies F and the fastener tapes C1 and C2 of the slide fastener chain C is formed on the respective outer circumference of the rollers 65. In addition, the needle sections 66 are disposed on the outer circumference of the roller 65, at substantially regular intervals in the circumferential direction, and radially extend outward. In the meantime, although both the pair of left and right fastener tapes C1 and C2 are pressed by the pair of rollers 65 in this embodiment, this is not intended to be limiting. Rather, it is possible to provide only one roller 65 such that the roller presses only one of the pair of left and right fastener tapes C1 and C2.

The base member 62 has an element-receiving recess 62*b* in the undersurface thereof. The element-receiving recess 62*b* receives the engaged fastener elements C3 and C4 of the pair of left and right fastener tapes C1 and C2, and is formed along the fly transfer passage 3. In addition, the support table 71 has slits 71*a* and 71*a* through which the needle sections 66 and 66 of the pair of rollers 65 extend.

In addition, the pair of rollers 65 of the auxiliary conveyance unit 60 rotates as the flies F and the slide fastener chain C to which the needle sections 66 thereof are fitted are sewn by the sewing machine part 70 and are then sent downstream. That is, a power of the pair of rollers 65 is a sending force of the sewing machine part 70 for sending the flies F and the slide fastener chain C which are overlapped to the downstream side thereof while stitching the flies F and the slide fastener chain C together. Owing to this, the pair of rollers 65 rotates in synchronization with the sewing speed of the sewing machine part 70. In addition, since the pair of rollers 65 rotates in the state in which the needle sections 66 are fitted into the flies F and the slide fastener chain C, the flies F and the slide fastener chain C are sent to the sewing machine part 70 via the rotation. In addition, the needle sections 66 are adapted to be sequentially released after being fitted into the flies F and the slide fastener chain C by the rotation of the rollers 65.

As described above, the fly sewing machine 1 of this embodiment includes the fly supply unit 10 which supplies the flies F to the fly transfer passage 3 of the stand 2, the fly transfer unit 20 which transfers and sends the flies F supplied by the fly supply unit 10 to the downstream side thereof the chain feed unit 50 which feeds a slide fastener chain C onto the flies F sent by the fly transfer unit 20, the auxiliary conveyance unit 60 which presses the flies F and the slide fastener chain C which are overlapped in the chain feed unit 50 from above or below and sends the flies F and the slide fastener chain C to the downstream side thereof, and the sewing machine part 70 which stitches the flies F to the slide fastener chain C. Accordingly, even though the length of the flies F is shorter than the distance between the position at which the fly transfer unit 20 sends the flies F and the position of the pressing section 72 of the sewing machine part 70, it is possible to stably send the flies F, thereby reliably stitching the flies F to the slide fastener chain C.

In addition, according to the fly sewing machine 1 of this embodiment, the plurality of needle sections 66 which extend through the flies F and the slide fastener chain C is formed in the outer circumference of the pair of rollers 65. Accordingly, it is possible to reliably send the flies F and the slide fastener chain C to the sewing machine part 70 in the downstream side so that the positions thereof are not misaligned.

In addition, according to the fly sewing machine 1 of this embodiment, the support shaft 63 which rotatably supports the pair of rollers 65 is pivotably supported by the rotary shaft 64. Even though the surface of the flies F and the slide fastener chain C which are sent to the pair of rollers 65 is uneven, the uneven surface is absorbed by pivoting of the pair of rollers 65. Accordingly, it is possible to reliably send the flies F and the slide fastener chain C to the sewing machine part 70 in the downstream side.

In addition, according to the fly sewing machine 1 of this embodiment, the power of the pair of rollers 65 of the auxiliary conveyance unit 60 is the sending force of the sewing machine part 70 which sends the flies F and the slide fastener chain C which are overlapped each other to the downstream side while stitching the flies F and the slide fastener chain C together. Accordingly, it is not required to separately provide a power source of the pair of rollers 65, thereby making it is possible to reduce the manufacturing cost of the fly sewing machine 1.

Figure 9:
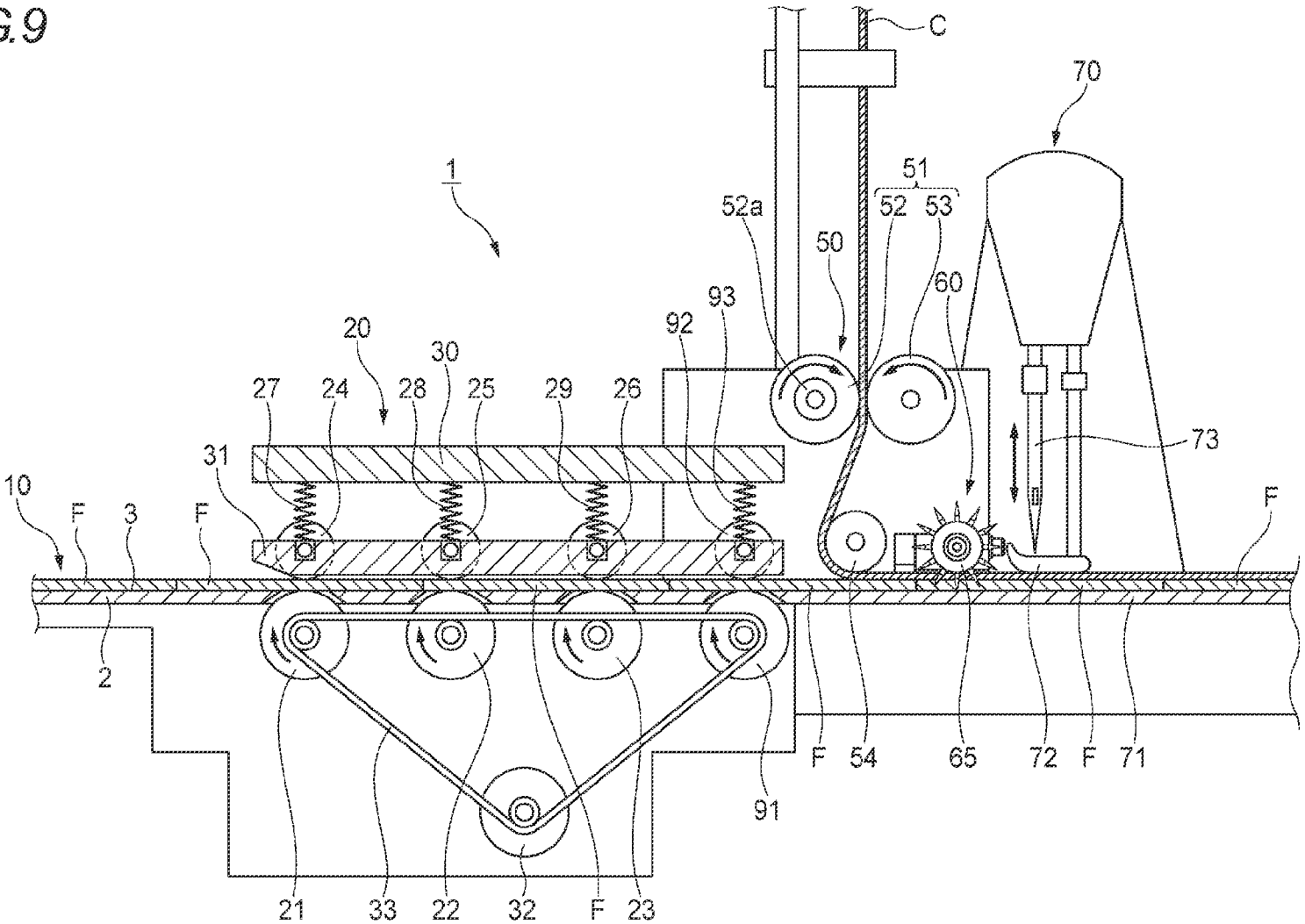
FIG. 9 is a partially cutaway side view depicting a first modified view of one embodiment of the fly sewing machine according to the invention.

In addition, as a first modified embodiment of this embodiment, as shown in FIG. 9, the transfer speed-adjusting part 40 may be omitted. In this case, the fly transfer unit 20 includes first to fourth drive rollers 21 to 23 and 91 which are disposed along the fly transfer passage 3 at predetermined intervals, first to fourth support rollers 24 to 26 and 92 which are disposed above the fourth drive rollers 21 to 23 and 91 such that a respective support roller faces a respective drive roller, first to fourth springs 27 to 29 and 93 each of which elastically urges a respective one of the first to fourth support rollers 24 to 26 and 92 toward a respective one of the drive rollers 21 to 23 and 91, and upper and lower support frames 30 and 31 which support the first to fourth support rollers 24 to 26 and 92 toward the first to fourth drive rollers 21 to 23 and 91 such that the drive rollers can freely reciprocate. The first to fourth drive rollers 21 to 23 and 91 are driven by the power transmission belt 33 which is driven by the single drive motor 32 so that the rollers 21 to 23 and 91 rotate at the same speed.

Figure 10:
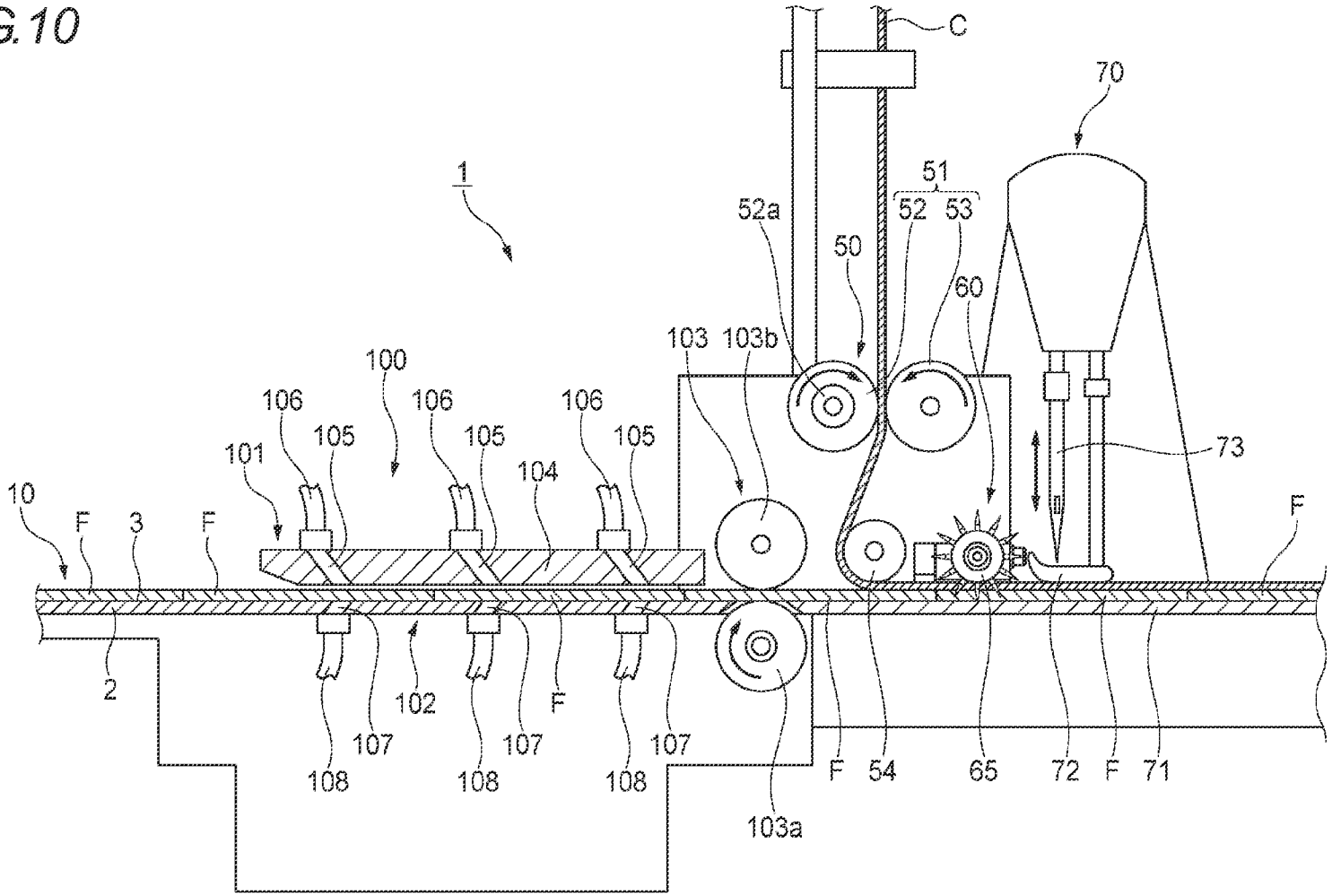
FIG. 10 is a partially cutaway side view depicting a second modified view of one embodiment of the fly sewing machine according to the invention.

In addition, as a second modified embodiment of this embodiment, as shown in FIG. 10, the fly transfer unit 20 may be substituted by a fly transfer unit 100 which transfers flies F by blowing air. The fly transfer unit 100 includes an upper air-blowing section 101, a lower air-blowing section 102 which blows air onto the undersurface of the flies F, and a roller device 103 which sends the flies F transferred by the air-blowing sections 101 and 102 to the downstream side.

The upper air-blowing section 101 includes a support frame 104 which is disposed above the flies F with a predetermined interval, three blow-holes 105 which are formed in the support frame 104 with predetermined intervals in the direction in which the flies are transferred, and air feed nozzles 106 each of which is connected to a respective one of the three blow holes 105. In addition, the blow holes 105 are inclined downward toward the downstream direction.

The lower air-blowing section 102 has three blow holes 107 which are formed in the stand 2 with predetermined intervals in the direction in which the flies are transferred and air feed nozzles 108 each of which is connected to a respective one of the three blow holes 107. In addition, the blow holes 107 are inclined upward toward the downstream direction.

The roller device 103 includes a drive roller 103*a* which is driven by a power transmission motor which is not shown and a follower roller 103*b*. In addition, in the fly transfer unit 100 which is configured as above, the flies F are caused to slightly float on air that is blown through the blow holes 105 and blow holes 107. In this state, the flies F are transferred to the roller device 103, and are then sent downstream by the roller device 103.

Figure 11:
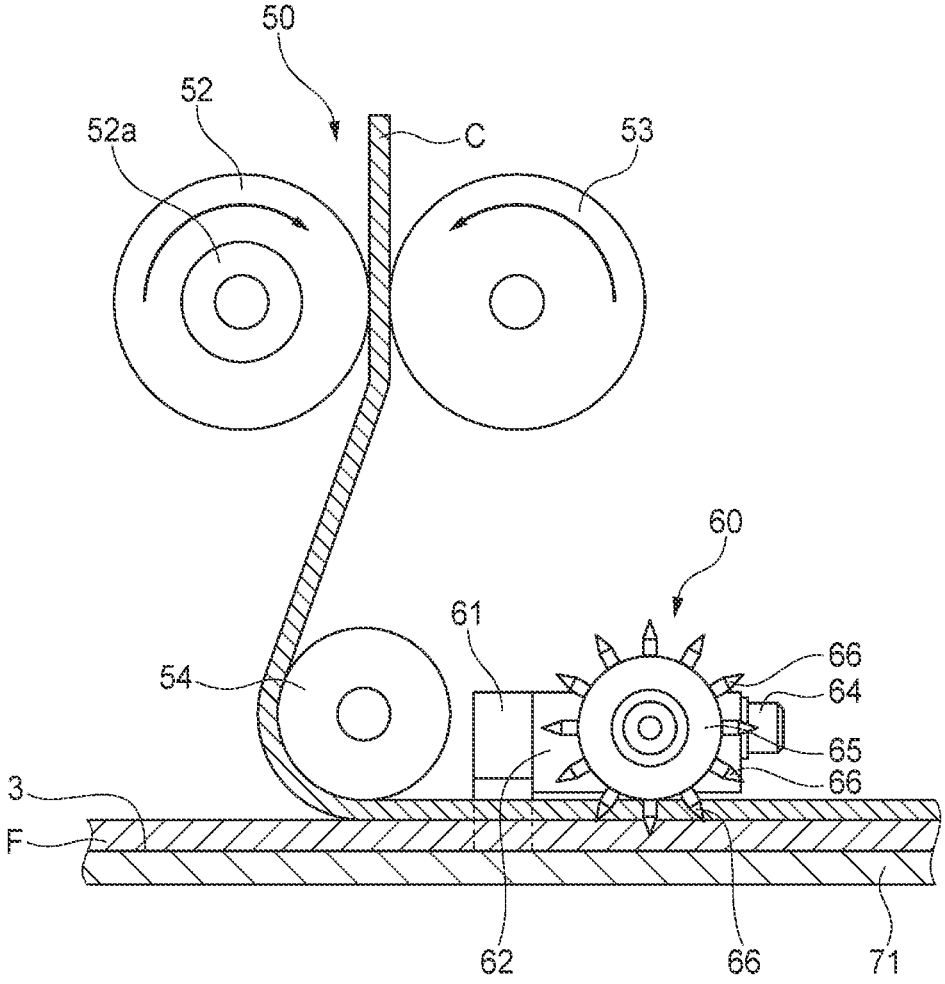
FIG. 11 is an enlarged side view depicting a first modified view of the auxiliary conveyance unit.

In addition, as the first modified embodiment of the auxiliary conveyance unit 60, the needle sections 66 of the roller 65 penetrate through both the flies F and the slide fastener chain C in the above-described configuration. However, as shown in FIG. 11, the length of the needle sections 66 may be shortened such that the needle sections penetrate through only the slide fastener chain C but merely press the flies F.

Figure 12:
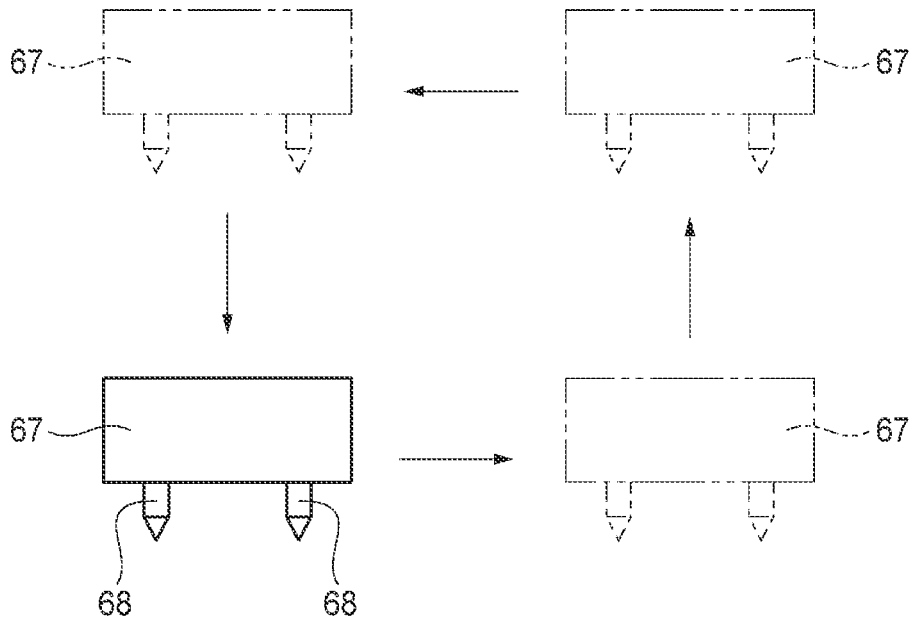
FIG. 12 is an enlarged side view depicting a second modified view of the auxiliary conveyance unit.

In addition, as the second modified embodiment of the auxiliary conveyance unit 60, as shown in FIG. 12, the roller 65 of the above-described embodiment may be substituted by a pressing member 67 which has a rectangular motion trace. The pressing member 67 is a rectangular body, and has at least one needle section 68 (two needle sections in this modified embodiment) on the undersurface thereof. The needle sections 68 penetrate through the slide fastener chain C and penetrate through or press the flies F. In the meantime, the rectangular motion of the pressing member 67 uses a pneumatic or hydraulic cylinder.

In the meantime, the present invention is not limited to the above-described embodiments but can be suitably modified without departing from the scope of the invention.

In an example, the roller 65 may be disposed below the fly transfer passage 3 such that the needle sections 65 penetrate through the flies F and press the fastener chain C or penetrate through both the flies F and the fastener chain C.

DESCRIPTION OF REFERENCE NUMERALS

1 Fly Sewing Machine
C Slide Fastener Chain
C1 Fastener Tape
C2 Fastener Tape
F Fly
2 Stand
3 Fly Transfer Passage
10 Fly Supply Unit
20 Fly Transfer Unit
50 Chain Feed Unit
60 Auxiliary Conveyance Unit
63 Support Shaft
64 Rotary Shaft
65 Roller
66 Needle Section
70 Sewing Machine Part

The invention claimed is:

1. A fly sewing machine configured to continuously stitch a plurality of flies each made of a piece of cloth to an elongated slide fastener chain, the fly sewing machine comprising:

a fly supply unit configured to supply the flies to a fly transfer passage;

a fly transfer unit disposed downstream of the fly supply unit and configured to transfer and send the flies supplied by the fly supply unit to a downstream side thereof;

a chain feed unit disposed downstream of the fly transfer unit and configured to feed the slide fastener chain onto the flies sent by the fly transfer unit;

an auxiliary conveyance unit disposed downstream of the chain feed unit and configured to press the flies and the slide fastener chain which are overlapped by the chain feed unit from above or below and to send the flies and the slide fastener chain to a downstream side thereof; and a sewing machine part disposed downstream of the auxiliary conveyance unit and configured to stitch the flies to the slide fastener chain.

2. The fly sewing machine of claim 1, wherein the auxiliary conveyance unit comprises at least one needle section configured to penetrate through at least one of the flies and the slide fastener chain.

3. The fly sewing machine of claim 2, wherein the auxiliary conveyance unit comprises a support shaft provided perpendicular to the fly transfer passage and at least one roller rotatably supported by the support shaft, and wherein the at least one needle section is a plurality of the needle sections which are provided on an outer circumferential surface of the at least one roller.

4. The fly sewing machine of claim 3, wherein the at least one roller is a pair of rollers rotatably provided on both ends of the support shaft and the auxiliary conveyance unit further comprises the pair of the rollers and a rotary shaft provided along the fly transfer passage, the rotary shaft pivotably supporting the support shaft.

5. The fly sewing machine of claim 1, wherein a power of the auxiliary conveyance unit is a sending force of the sewing machine part for sending the flies and the slide fastener chain which are overlapped to the downstream side thereof while stitching the flies and the slide fastener chain together.

* * * * *